US011002220B1

(12) United States Patent
Ichikawa et al.

(10) Patent No.: US 11,002,220 B1
(45) Date of Patent: May 11, 2021

(54) CYLINDER BLOCK

(71) Applicant: Mazda Motor Corporation, Hiroshima (JP)

(72) Inventors: Kazuo Ichikawa, Aki-gun (JP); Tsuguhisa Miyamoto, Aki-gun (JP); Yoshihisa Nou, Aki-gun (JP); Yuma Miyauchi, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 16/951,328

(22) Filed: Nov. 18, 2020

(30) Foreign Application Priority Data

Dec. 9, 2019 (JP) ..... JP2019-222238

(51) Int. Cl.
*F02B 75/22* (2006.01)
*F02F 7/00* (2006.01)

(52) U.S. Cl.
CPC ..... *F02F 7/0085* (2013.01); *F02F 7/0007* (2013.01)

(58) Field of Classification Search
CPC . F02F 1/004; F02F 1/16; F02F 7/0085; F05C 2253/16; F16J 10/04
USPC ..... 123/668, 195 R, 193.2, 193.4
See application file for complete search history.

(56) References Cited

U.S. PATENT DOCUMENTS 4,466,399 A * 8/1984 Hinz ..... F16J 10/04 123/193.4
6,588,408 B2 * 7/2003 Bedwell ..... F02F 1/16 123/668
2013/0340700 A1 * 12/2013 Donahue ..... F16J 10/04 123/193.2
2017/0067411 A1 * 3/2017 Doho ..... F01P 3/02
2018/0030922 A1 * 2/2018 Kia ..... F02F 7/0085
2019/0277220 A1 * 9/2019 Horigome ..... F02F 1/004

FOREIGN PATENT DOCUMENTS

JP 2019015227 A 1/2019

* cited by examiner

*Primary Examiner* — Long T Tran
*Assistant Examiner* — James J Kim
(74) *Attorney, Agent, or Firm* — Alleman Hall Creasman & Tuttle LLP

(57) ABSTRACT

A cylinder block includes a metal body part having a cylinder, and an outer wall part made of fiber reinforced resin, surrounding an outer circumference of the body part. A part of the outer wall part at BDC side in a cylinder axis direction contacts a bottom wall forming part. The outer wall part is comprised of an inner layer surrounding the outer circumference of the body part, and an outer layer surrounding an outer circumference of the inner layer. A density of reinforcing fiber contained in the outer layer is higher than that in the inner layer. A thickness of a part of the inner layer at BDC side in the cylinder axis direction is greater than that of the TDC-side inner layer. A thickness of a part of the outer layer at TDC side in the cylinder axis direction is greater than that of the BDC-side outer layer.

18 Claims, 5 Drawing Sheets

CYLINDER BLOCK

TECHNICAL FIELD

The present disclosure relates to a cylinder block.

BACKGROUND OF THE DISCLOSURE

For reducing the weight of an engine for automobiles, etc. to improve fuel efficiency, various technologies of forming a cylinder block partially with resin are proposed.

For example, as illustrated in FIG. 5, JP2019-015227A discloses a cylinder block 100 which includes a metal body part 101 having a cylinder 101*b* extending in a cylinder axis direction A, and an outer wall part 102 made of fiber reinforced resin. The body part 101 has a cylindrical circumferential wall 101*a* which forms the cylinder 101*b*, and a bottom wall forming part 101*c* which protrudes outward from an outer surface of the circumferential wall 101*a*. An inner circumferential surface of the circumferential wall 101*a* is covered with a cylinder liner 107.

The outer wall part 102 is comprised of two layers of an inner layer 103 and an outer layer 104 which are made of fiber reinforced resin. The inner layer 103 is made of resin containing glass fiber, and the outer layer 104 is made of resin containing carbon fiber.

In a lower end part 106 of the cylinder block 100, a part 102*a* of the outer wall part 102, which protrudes radially inward, contacts the bottom wall forming part 101*c* of the body part 101. Thus, between the body part 101 and the outer wall part 102, a coolant passage 105 where a coolant W for cooling the cylinder block 100 circulates is formed.

From a viewpoint of reducing a sliding resistance of a piston which reciprocates inside the cylinder 101*b*, it is desirable to make a thermal deformation of the cylinder liner 107 substantially uniform in the cylinder axis direction A. Thus, the cylinder liner is required to have a substantially uniform temperature distribution in the cylinder axis direction A.

However, in the lower end part 106 of the cylinder block 100, since the outer wall part 102 contacts the body part 101, heat generated in the cylinder 101*b* of the body part 101 is transmitted via the lower end part 106 to the ascending circumferential direction of the outer wall part 102 made of the fiber reinforced resin, and is released outside from the outer layer 104, as illustrated by a path of an arrow B. Thus, the cylinder liner 107 may have an uneven temperature distribution in the cylinder axis direction A.

Particularly, when the reinforcing fiber contained in the outer wall part 102 has a high density, it increases the rigidity of the outer wall part 102 but also increases the thermal conductivity of the outer wall part 102, which easily causes heat release. Therefore, since in the above structure the reduction in the thermal conductivity of the outer wall part 102 reduces the rigidity of the outer wall part 102, it is difficult to secure the rigidity of the outer wall part 102 while reducing the heat release of the outer wall part 102.

SUMMARY OF THE DISCLOSURE

The present disclosure is made in view of the above situations, and one purpose thereof is to provide a cylinder block provided with an outer wall part made of fiber reinforced resin, which can achieve a uniform temperature distribution of a cylinder liner in a cylinder axis direction while securing the rigidity of the cylinder block.

According to one aspect of the present disclosure, a cylinder block is provided, which includes a body part made of metal, having a circumferential wall forming a cylindrical cylinder where a piston is reciprocatable therein, and a bottom wall forming part protruding outwardly from an external surface of the circumferential wall, and an outer wall part made of fiber reinforced resin, surrounding an outer circumference of the body part and forming a cooling water passage together with the circumferential wall and the bottom wall forming part. A part of the outer wall part at a bottom dead center side in a cylinder axis direction is in contact with the bottom wall forming part. The outer wall part is comprised of an inner layer surrounding the outer circumference of the body part, and an outer layer surrounding an outer circumference of the inner layer. A density of reinforcing fiber contained in the outer layer is higher than a density of reinforcing fiber contained in the inner layer. A thickness of a part of the inner layer at the bottom dead center side in the cylinder axis direction is greater than a thickness of a part of the inner layer at a top dead center side. A thickness of a part of the outer layer at the top dead center side in the cylinder axis direction is greater than a thickness of a part of the outer layer at the bottom dead center side.

According to this configuration, the part of the outer wall part of the cylinder block at the bottom dead center side in the cylinder axis direction is in contact with the bottom wall forming part of the metal body part. The outer wall part is formed in the two-layer structure comprised of the inner layer and the outer layer, and the density of the reinforcing fiber contained in the outer layer is greater than the density of the reinforcing fiber contained in the inner layer. Thus, by reducing the reinforcing fiber density in the inner layer as compared with the outer layer, it is possible to reduce the thermal effusivity of the inner layer so that the heat permeation from the body part into the inner layer is suppressed. In addition, since the thickness of the part of the inner layer at the bottom dead center side in the cylinder axis direction is greater than the thickness of the part at the top dead center side, an escape of heat from the part of a cylinder liner at the bottom dead center side with a comparatively low temperature to the outer wall part can be reduced. Therefore, it is possible to reduce unevenness of a temperature distribution of the cylinder liner in the cylinder axis direction.

Moreover, the thickness of the part of the outer layer at the top dead center side in the cylinder axis direction is greater than the thickness of the part at the bottom dead center side. Thus, since the thickness of the layer with the high reinforcing fiber density in the upper part to which a surface pressure caused by contacting the cylinder head with an upper end of the cylinder block is applied is increased, the rigidity can be secured.

As a result, it is possible to achieve both the uniform temperature distribution of the cylinder liner in the cylinder axis direction and the sufficient rigidity of the cylinder block.

The outer layer may be formed by laminating sheets made of fiber reinforced resin in a thickness direction of the outer layer, and the outer layer may be configured so that the number of sheets at the bottom dead center side in the cylinder axis direction is less than the number of sheets at the top dead center side.

According to this configuration, by laminating the sheets to form the outer layer of the outer wall part with the high reinforcing fiber density, the quality control for the outer wall part becomes easier. Therefore, it is possible to reduce the thickness of the part of the outer layer at the bottom dead center side so that the escape of the heat to the exterior is securely suppressed.

Moreover, by adjusting the number of sheets, it is possible to deal with the request for the cooling capability of the outer wall part. Therefore, for example, when there is a part desirable to improve the cooling capability in the cylinder axis direction of the cylinder block, it is possible to easily achieve the cooling capability by increasing the number of sheets and thickening the outer layer only at this part.

A stepped part may be formed in the outer layer at the bottom dead center side in the cylinder axis direction by gradually reducing the number of sheets to the bottom dead center side.

According to this configuration, it is possible to suppress the escape of the heat to the exterior in the cylinder axis direction with more sufficient accuracy by gradually reducing the thickness of the part of the outer layer at the bottom dead center side and to further reduce the unevenness of the temperature distribution of the cylinder liner in the cylinder axis direction.

The inner layer may contain hollow particles.

According to this configuration, due to the air inside the hollow particles, it is possible to improve the heat retention effect of the inner layer.

A density of the hollow particles in a part of the inner layer at the bottom dead center side in the cylinder axis direction may be higher than a density of the hollow particles in a part of the inner layer at the top dead center side.

According to this configuration, it is possible to improve the heat retention effect of the inner layer at the bottom dead center side. Thus, it is possible to further suppress the escape of the heat to the outer wall part from the part of the cylinder liner at the bottom dead center side and to further reduce the unevenness of the temperature distribution of the cylinder liner in the cylinder axis direction.

The cylinder may include a plurality of cylinders lined up in an engine output shaft direction. The thickness of the outer layer at least in a part at the bottom dead center side in the cylinder axis direction at a position corresponding to an inter-bore part defined as a coupling part of the adjacent cylinders in the engine output shaft direction may be greater than a thickness of the outer layer in a part corresponding to a cylinder axis.

The position corresponding to the inter-bore part defined as the coupling part of the adjacent cylinders in the engine output shaft direction is the part which tends to accumulate the heat by the heat transfer from the two adjacent cylinders. Thus, in this configuration, at the position corresponding to the inter-bore part, since the thickness of the outer layer at least in the part at the bottom dead center side in the cylinder axis direction is greater than the thickness of the outer layer at the part corresponding to the cylinder axis, it is possible to increase heat dissipation. Therefore, it is possible to reduce the unevenness of the temperature distribution in the inter-bore part of the cylinder and at the cylinder axis, and, as a result, the cylinder liner unevenly deforming in the circumferential direction is prevented.

DETAILED DESCRIPTION OF THE DISCLOSURE

Hereinafter, one desirable embodiment of the present disclosure is described in detail with reference to the accompanying drawings.

Figure 1:
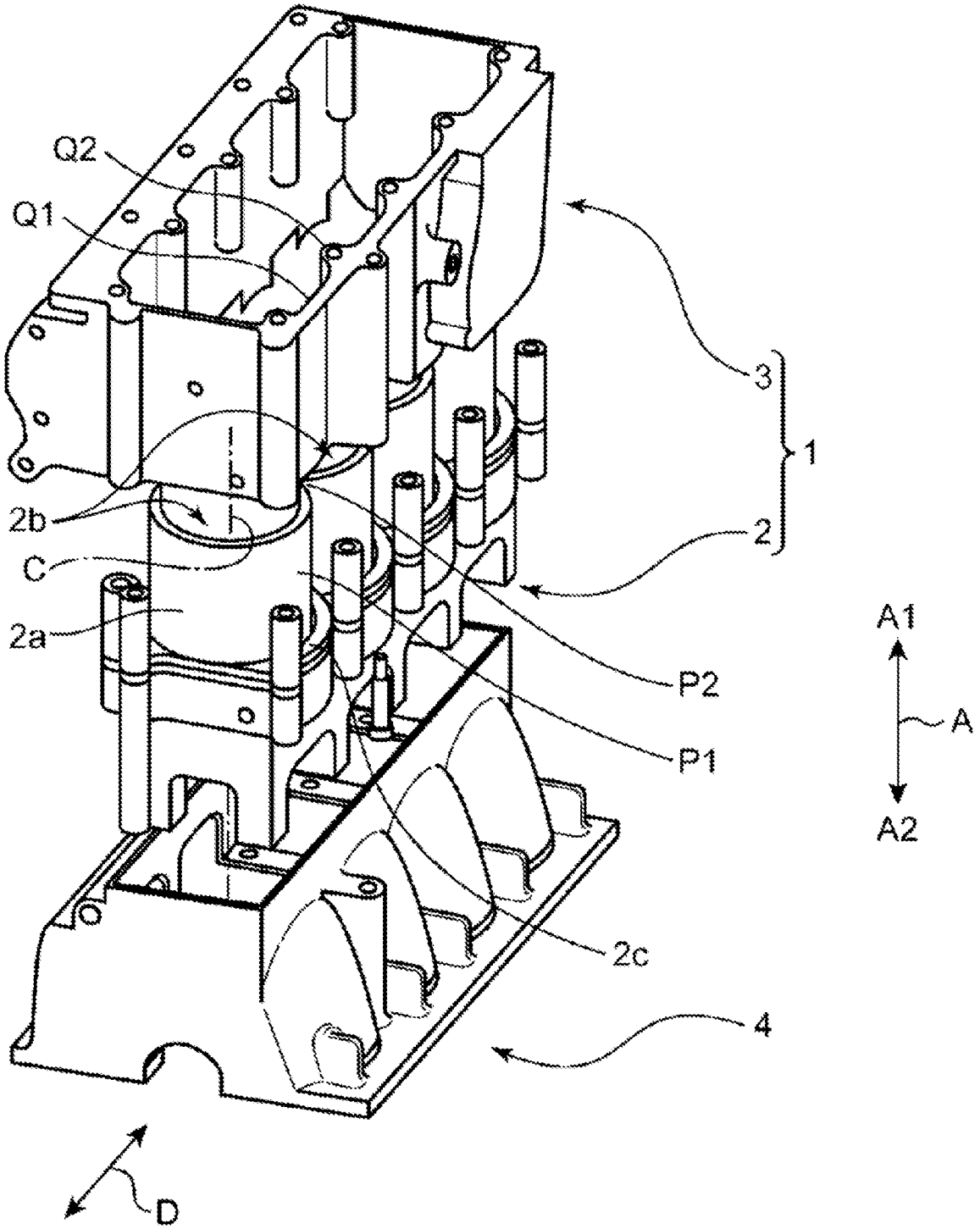
FIG. 1 is an exploded perspective view illustrating the overall configuration of a cylinder block according to one embodiment of the present disclosure.
Figure 2:
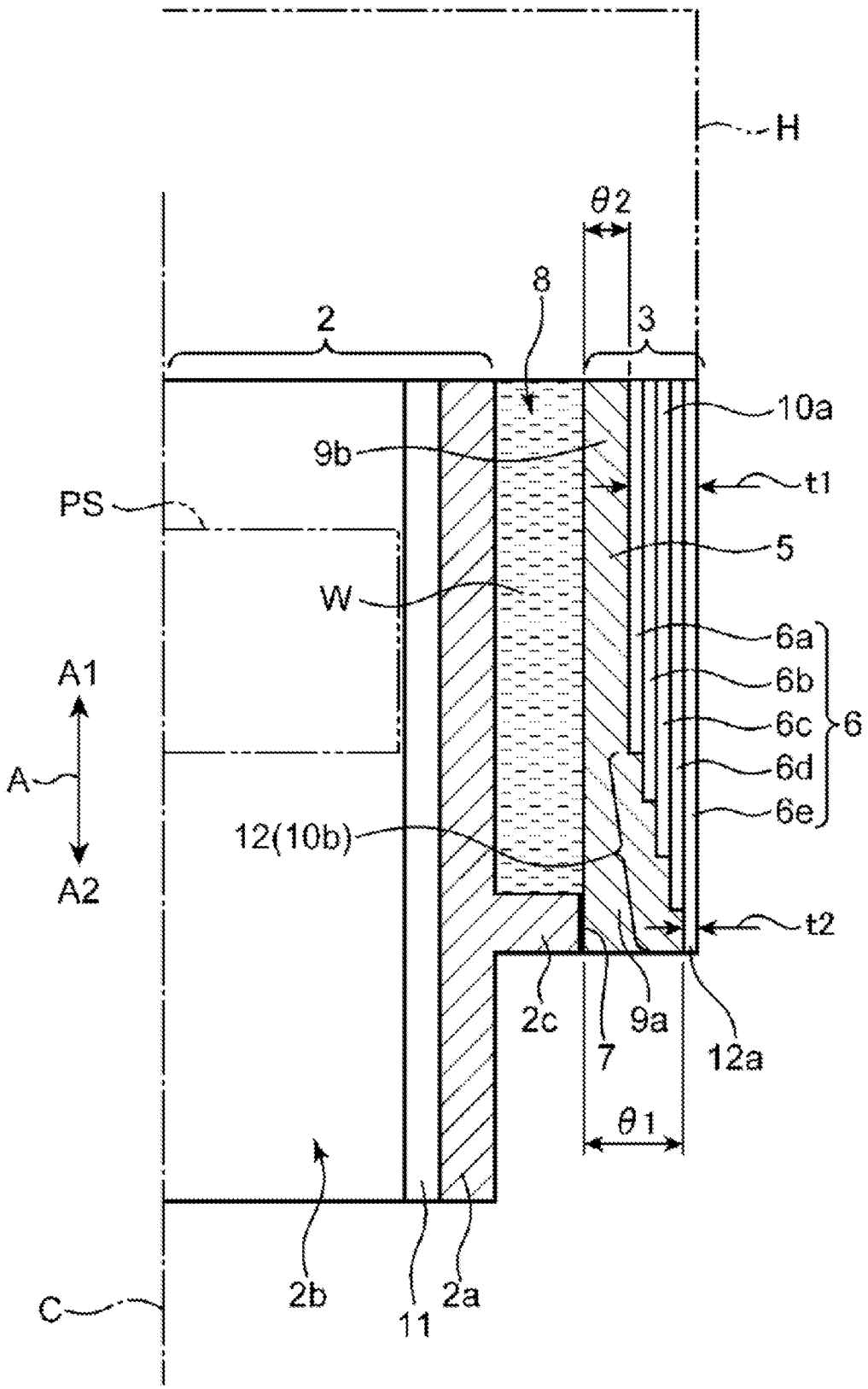
FIG. 2 is an enlarged cross-sectional view of a bore center part of the cylinder block in FIG. 1.

As illustrated in FIGS. 1 and 2, a cylinder block 1 of an internal combustion engine includes a body part 2 made of metal, and an outer wall part 3 made of fiber reinforced resin which surrounds an outer circumference of the body part 2.

The metal body part 2 has a plurality of cylinders 2*b* lined up in an engine output shaft direction D, and substantially constitute a main part of a multi-cylinder engine. Each cylinder 2*b* is a cylindrical space extending in a cylinder axis direction A so that a piston PS reciprocates between a top dead center (TDC) and a bottom dead center (BDC). Note that the cylinder axis direction A may be a horizontal direction or an oblique direction, without being limited to the up-and-down or vertical direction in FIG. 1.

Moreover, as illustrated in FIG. 1, a crankcase 4 is attached to an end face of the body part 2 of the cylinder block 1 at a bottom dead center side A2. Moreover, a cylinder head H is fixed to an end face of the cylinder block 1 (both the body part 2 and the outer wall part 3) at a top dead center side A1 with cylinder-head bolts.

As illustrated in FIG. 2, the body part 2 has, for each cylinder, a circumferential wall 2*a* in which an inner circumferential surface thereof formed in a cylindrical shape is covered with a cylinder liner 11, and an area at the inner circumferential side of the cylinder liner 11 is defined as the cylinder 2*b*, and a bottom wall forming part 2*c* which protrudes outwardly from an external surface of the circumferential wall 2*a*. The body part 2 is made of metal with high heat resistance and high strength, such as an aluminum alloy.

The cylinder liner 11 is a cylindrical member having an inner diameter which can be fitted into piston rings (not illustrated) attached to a circumferential surface of the piston PS. The cylinder liner 11 supports the piston PS which reciprocates inside the cylinder 2*b*, and has a function for sealing a gap between the cylinder liner 11 and the piston rings so that combustion gas does not leak from the gap.

A cooling water passage 8 for circulating a coolant W through the outer circumference of the body part 2 is formed by the circumferential wall 2*a* and the bottom wall forming part 2*c* of the body part 2, and the outer wall part 3 (particularly, an inner layer 5) which covers the body part 2 from outside. A gap between the bottom wall forming part 2*c* and the outer wall part 3 (particularly, the inner layer 5) is sealed by a packing 7. Therefore, a part of the outer wall part 3 at the bottom dead center side A2 in the cylinder axis direction A (in detail, a part 9*a* of the inner layer 5 at the bottom dead center side A2) is in contact with the bottom wall forming part 2*c* via the packing 7. Note that the bottom wall forming part 2*c* and the outer wall part 3 may contact directly with each other without intervening the packing 7, as long as the water tightness of the cooling water passage 8 can be secured.

The outer wall part 3 is comprised of the inner layer 5 which surrounds the outer circumference of the body part 2, and an outer layer 6 which surrounds the outer circumference of the inner layer 5.

The inner layer 5 and the outer layer 6 are each made of fiber reinforced resin. In this embodiment, both the inner layer 5 and the outer layer 6 are made of the fiber reinforced resin having an electric insulating property.

The fiber reinforced resin having the electric insulating property contains at least one fiber selected from a group consisting of glass fiber, aramid fiber, and basalt fiber. Note that the inner layer 5 and the outer layer 6 may be made of a fiber reinforced resin without the electric insulating property (e.g., carbon resin).

The reinforcing fiber density in the outer layer 6 is higher than the reinforcing fiber density in the inner layer 5.

For example, the weight percentage of the reinforcing fiber contained in the outer layer 6 is about 35 wt % when the aramid fiber is used, and about 54 wt % when the glass fiber is used. On the other hand, the weight percentage of the reinforcing fiber contained in the inner layer 5 is 30 wt % when the glass fiber is used.

A thickness θ1 of the part 9*a* of the inner layer 5 at the bottom dead center side A2 in the cylinder axis direction A is greater than a thickness θ2 of a part 9*b* at the top dead center side A1.

Moreover, a thickness t1 of a part 10*a* of the outer layer 6 at the top dead center side A1 in the cylinder axis direction A is greater than a thickness of a part 10*b* at the bottom dead center side A2 (a stepped part 12 described later).

In detail, the outer layer 6 of the embodiment is formed by laminating fiber reinforced resin sheets 6*a*-6*e* having the same thickness in a thickness direction of the outer layer 6.

The sheets 6*a*-6*e* may be, for example, sheets in which reinforcing fiber is oriented in a surface direction, and may be, for example, sheets comprised of nonwoven fabric in which the reinforcing fiber is oriented in random directions in the surface. Note that the reinforcing fiber may be oriented in a given direction in the surfaces of the sheets.

The outer layer 6 is configured so that the number of sheets 6*a*-6*e* at the bottom dead center side A2 in the cylinder axis direction A is less than the number of sheets 6*a*-6*e* in the part 10*a* at the top dead center side A1 (five sheets in FIG. 2).

In this embodiment, the part 10*b* of the outer layer 6 at the bottom dead center side A2 in the cylinder axis direction A illustrated in FIG. 2 is comprised of the stepped part 12 which is formed so that the number of sheets 6*a*-6*e* decreases gradually as it goes to the bottom dead center side A2.

The thickness of the stepped part 12 is less than the thickness t1 of the part 10*a* of the outer layer 6 at the top dead center side A1, and the thickness becomes gradually decreases as it goes to the bottom dead center side A2, and it eventually becomes a thickness t2 (i.e., a thickness of one sheet which is the outermost layer sheet 6*e*) in an end part 12*a* of the stepped part 12 at the bottom dead center side A2.

Note that in this embodiment, in the configuration in which the body part 2 has the plurality of cylinders 2*b* lined up in the engine output shaft direction D, a part near an inter-bore part P2 (see FIG. 1) between the adjacent cylinders 2*b* where heat tends to be accumulated is configured to easily release the heat by making the thickness of the outer layer 6 in at least a part 13 (see FIG. 3) of the outer layer 6 at the bottom dead center side A2 in the cylinder axis direction A thicker.

Figure 3:
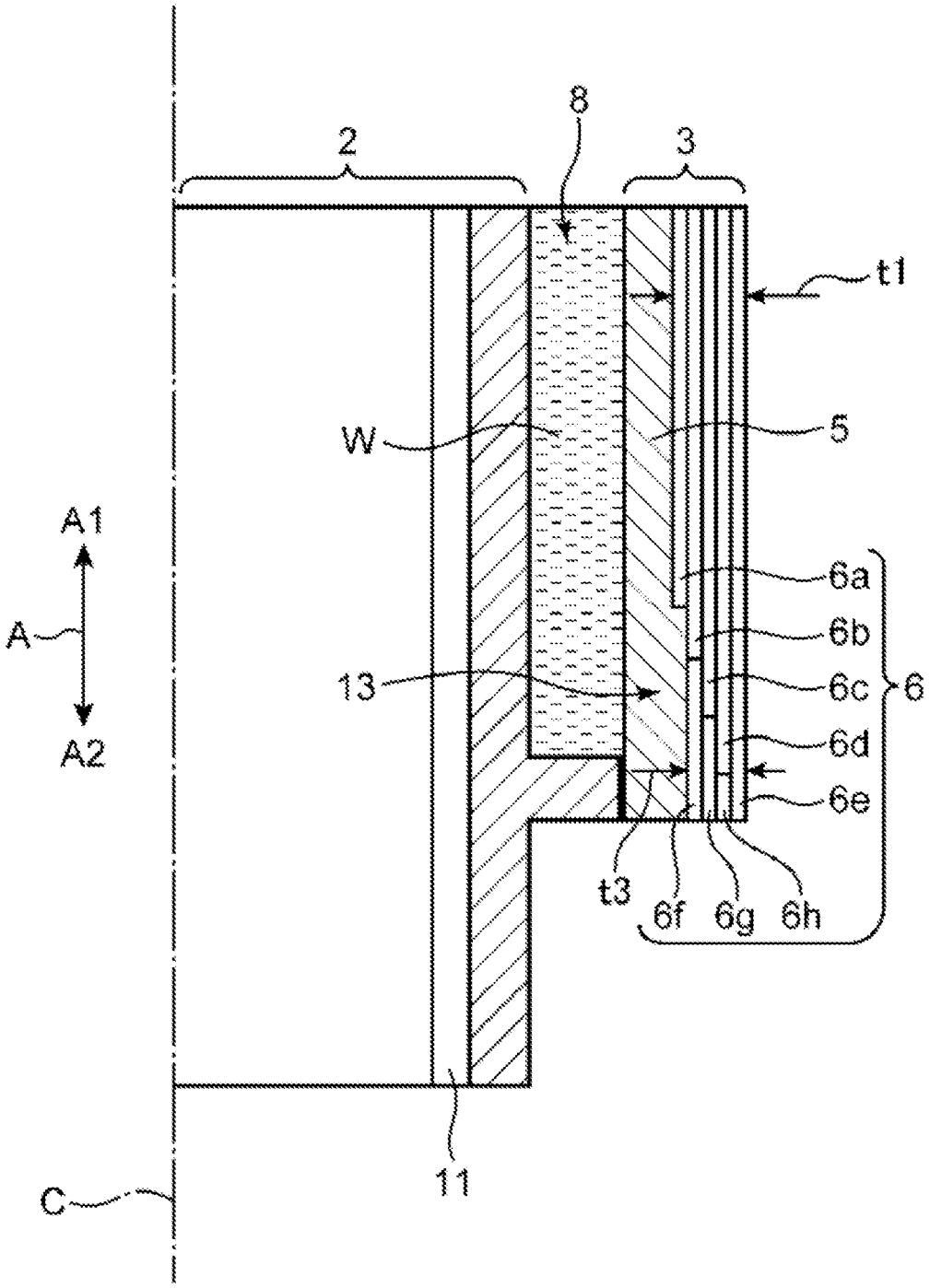
FIG. 3 is an enlarged cross-sectional view of an inter-bore part of the cylinder block in FIG. 1.

That is, as illustrated in FIG. 3, at a position Q2 corresponding to an inter-bore part P2 which is defined as a coupling part between the adjacent cylinders 2*b* in the engine output shaft direction D illustrated in FIG. 1, a thickness t3 of the outer layer 6 at least in the part 13 at the bottom dead center side A2 in the cylinder axis direction A is greater than a thickness of the outer layer 6 in a part Q1 corresponding to an axis C of the cylinder 2*b* illustrated in FIG. 1 (e.g., a thickness of the stepped part 12 of the outer layer 6 at the bottom dead center side A2 illustrated in FIG. 2 (it is less than t3, and equal to or greater than the thickness t2)). Note that in this embodiment the thickness t3 of the outer layer 6 is partially increased only at the part 13 at the bottom dead center side A2.

In detail, the part 13 (see FIG. 3) of the outer layer 6 at the bottom dead center side A2 at the position Q2 corresponding to the inter-bore part P2 is thicker than a part of the outer layer 6 at the bottom dead center side A2 at the part Q1 corresponding to the axis C of the cylinder 2*b* (in detail, the bore center part P1 of FIG. 1), i.e., the stepped part 12 (see FIG. 2).

The part 13 (see FIG. 3) at the bottom dead center side A2 is formed, for example, by adding sheets 6*f*, 6*g*, and 6*h* so as to be adjacent to the sheets 6*b*, 6*c*, and 6*d*, respectively, and adjusting the length of four layers 6*b*-6*e* among the sheets 6*a*-6*e* to the length of the outermost layer sheet 6*e*. Note that the sheets 6*b*, 6*c*, and 6*d* may be extended to the same length as the sheet 6*e*.

Thus, at the position Q2 corresponding to the inter-bore part P2, as illustrated in FIG. 3, by making at least the part 13 of the outer layer 6 at the bottom dead center side A2 in the cylinder axis direction A thicker, heat becomes easier to escape from the outer layer 6 with the high reinforcing fiber density, and thereby, the heat accumulation can be prevented.

When manufacturing the outer wall part 3 having the two-layer structure of the inner layer 5 and the outer layer 6 which are made of the fiber reinforced resin, for example, the plurality of nonwoven fabric sheets 6*a*-6*e* (see FIG. 2) containing a plurality of glass fibers which constitute the outer layer 6 are laminated on an inner circumferential surface of a die, and a molten resin material containing short glass fibers used as the material of the inner layer 5 is then poured into the die.

Feature of Embodiment (1) In the cylinder block 1 of this embodiment, the cylinder block 1 of the internal combustion engine includes, for each cylinder, the metal body part 2 having the circumferential wall 2*a* in which the cylindrical cylinder 2*b* where the piston is reciprocatable therein is formed, and the bottom wall forming part 2*c* which protrudes outward from the external surface of the circumferential wall 2*a*, and the outer wall part 3 made of the fiber reinforced resin which surrounds the outer circumference of the body part 2 and forms the cooling water passage 8 with the circumferential wall 2*a* and the bottom wall forming part 2*c*. The part 9*a* of the outer wall part 3 at the bottom dead center side A2 in the cylinder axis direction A is in contact with the bottom wall forming part 2*c*. The outer wall part 3 is comprised of the inner layer 5 which surrounds the outer circumference of the body part 2, and the outer layer 6 which surrounds the outer circumference of the inner layer 5. The reinforcing fiber density contained in the outer layer 6 is higher than the reinforcing fiber density contained in the inner layer 5. The thickness θ1 of the part 9*a* of the inner layer 5 at the bottom dead center side A2 in the cylinder axis direction A is greater than the thickness θ2 of the part 9*b* at the top dead center side A1. The thickness t1 of the part 10*a* of the outer layer 6 at the top dead center side A1 in the cylinder axis direction A is greater than the thickness of the part 10*b* at the bottom dead center side A2 (in this embodiment, the stepped part 12) (it is less than t1, and equal to or greater than the thickness t2).

According to this configuration, the part 9*a* of the outer wall part 3 of the cylinder block 1 at the bottom dead center side A2 in the cylinder axis direction A is in contact with the bottom wall forming part 2*c* of the metal body part 2. The outer wall part 3 is formed in the two-layer structure comprised of the inner layer 5 and the outer layer 6, and the reinforcing fiber density contained in the outer layer 6 is greater than the reinforcing fiber density contained in the inner layer 5. Thus, by increasing the rigidity of the outer layer 6 in the outer wall part 3 and relatively reducing the reinforcing fiber density contained in the inner layer 5 as compared with the outer layer 6, it is possible to reduce the thermal effusivity of the inner layer 5 so that the heat permeation from the body part 2 into the inner layer 5 is suppressed. In addition, since the thickness θ1 of the part 9*a* of the inner layer 5 at the bottom dead center side A2 in the cylinder axis direction A is greater than the thickness θ2 of the part 9*b* at the top dead center side A1, an escape of heat from the part 9 of the cylinder liner 11 at the bottom dead center side A2 with a comparatively low temperature to the outer wall part 3 can be reduced. Therefore, it is possible to reduce unevenness of a temperature distribution of the cylinder liner 11 in the cylinder axis direction A.

Moreover, the thickness t1 of the part 10*a* of the outer layer 6 at the top dead center side A1 in the cylinder axis direction A is greater than the thickness of the part 10*b* at the bottom dead center side A2 (in this embodiment, the stepped part 12) (it is less than t1, and equal to or greater than the thickness t2). Thus, since the thickness of the layer with the high reinforcing fiber density in the upper part to which a surface pressure caused by contacting the cylinder head H with an upper end of the cylinder block 1 is applied, is increased, the rigidity can be secured.

As a result, it is possible to achieve both the uniform temperature distribution of the cylinder liner 11 in the cylinder axis direction A and the sufficient rigidity of the cylinder block 1.

(2) Moreover, in the cylinder block 1 of the above embodiment, the part of the outer wall part 3 made of the fiber reinforced resin at the top dead center side A1 which is desirably stimulated the heat dissipation is increased in the ratio of the outer layer 6 with the high reinforcing fiber density in the thickness direction. On the other hand, the part at the bottom dead center side A2 which is desirably stimulated the thermal insulation is decreased in the ratio of the outer layer 6 with the high reinforcing fiber density in the thickness direction.

In detail, since the part 10*a* of the outer layer 6 at the top dead center side A1 in the cylinder axis direction A is also a part which becomes comparatively hot by the heat inputted from the cylinder head H and the coolant W, the thickness of the outer layer 6 with the high reinforcing fiber density is increased to stimulate the heat dissipation of the outer layer 6.

(3) In the cylinder block 1 of this embodiment, the outer layer 6 is comprised of the sheets 6*a*-6*e* made of the fiber reinforced resin being laminated in the thickness direction of the outer layer 6. The outer layer 6 is configured so that the number of sheets 6*a*-6*e* at the bottom dead center side A2 in the cylinder axis direction A is less than the number of sheets 6*a*-6*e* at the top dead center side A1.

According to this configuration, by laminating the sheets 6*a*-6*e* to form the outer layer 6 of the outer wall part 3 with the high reinforcing fiber density, the quality control for the outer wall part 3 becomes easier. Therefore, it is possible to reduce the thickness of the part 9*a* of the outer layer 6 at the bottom dead center side A2 so that the escape of the heat to the exterior is securely suppressed.

Moreover, by adjusting the number of sheets 6*a*-6*e*, it is possible to deal with the request for the cooling capability of the outer wall part 3. Therefore, for example, when there is a part desirable to improve the cooling capability in the cylinder axis direction A of the cylinder block 1 (e.g., the position Q2 corresponding to the inter-bore part P2 of the outer wall part 3 as illustrated in FIGS. 1 and 3), it is possible to easily achieve the cooling capability by increasing the number of sheets 6*a*-6*e* and thickening the outer layer 6 only at this part as illustrated in FIG. 3.

(4) In the cylinder block 1 of this embodiment, as illustrated in FIG. 2, the stepped part 12 is formed in the outer layer 6 at the bottom dead center side A2 in the cylinder axis direction A by gradually reducing the number of sheets 6*a*-6*e* as it goes to the bottom dead center side A2. With this configuration, it is possible to suppress the escape of the heat to the exterior in the cylinder axis direction A with more sufficient accuracy by gradually reducing the thickness of the part of the outer layer 6 at the bottom dead center side A2 and to further reduce the unevenness of the temperature distribution of the cylinder liner 11 in the cylinder axis direction A.

(5) In the cylinder block 1 of this embodiment, the body part 2 has the plurality of cylinders 2*b* lined up in the engine output shaft direction D. As illustrated in FIG. 3, the outer layer 6 is configured at the position Q2 corresponding to the inter-bore part P2 defined as the coupling part of the adjacent cylinders 2*b* in the engine output shaft direction D so that the thickness t3 of the outer layer 6 at least at the part 13 at the bottom dead center side A2 in the cylinder axis direction A is greater than the thickness of the outer layer 6 at the part Q1 corresponding to the axis C of the cylinder 2*b* (in detail, the bore center part P1) (i.e., the thickness of the stepped part 12 illustrated in FIG. 2).

The position Q2 corresponding to the inter-bore part P2 defined as the coupling part of the adjacent cylinders 2*b* in the engine output shaft direction D is the part which tends to accumulate the heat by the heat transfer from the two adjacent cylinders 2*b*. Thus, in the above configuration, at the position Q2 corresponding to the inter-bore part P2, since the thickness t3 of the outer layer 6 at least in the part 13 at the bottom dead center side A2 in the cylinder axis direction A is greater than the thickness of the outer layer 6 at the part Q1 corresponding to the axis C of the cylinder 2*b* (in detail, the bore center part P1) (the thickness of the stepped part 12 as illustrated in FIG. 2), it is possible to increase the heat dissipation. Therefore, it is possible to reduce the unevenness of the temperature distribution in the inter-bore part P2 of the cylinder 2*b* and at the axis C of the cylinder 2*b* (in detail, the bore center part P1), and, as a result, the cylinder liner 11 unevenly deforming in the circumferential direction is prevented.

Figure 4:
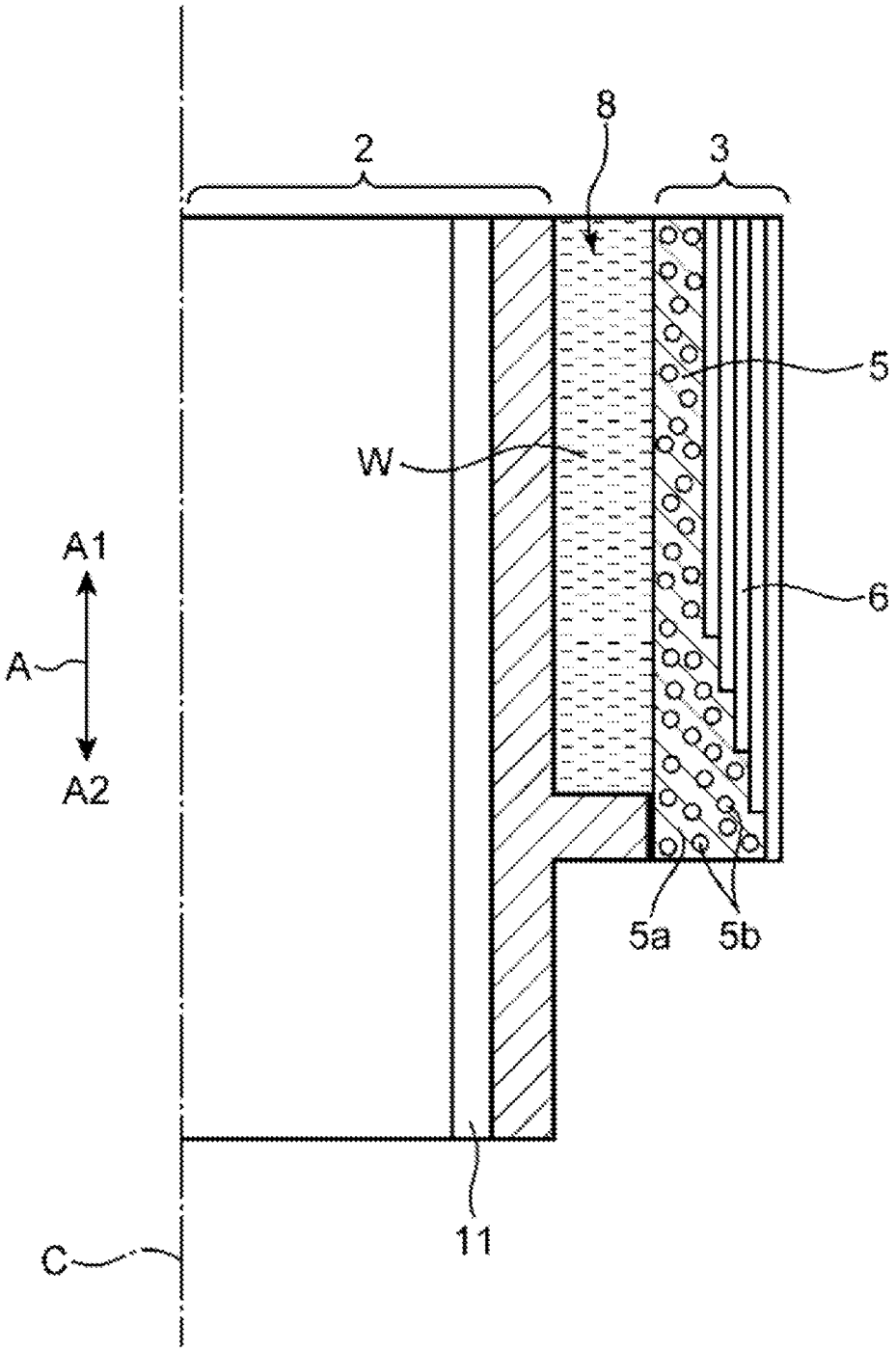
FIG. 4 is an enlarged cross-sectional view of a structure of a cylinder block according to a modification of the present disclosure where hollow particles are contained in an inner layer.
Figure 5:
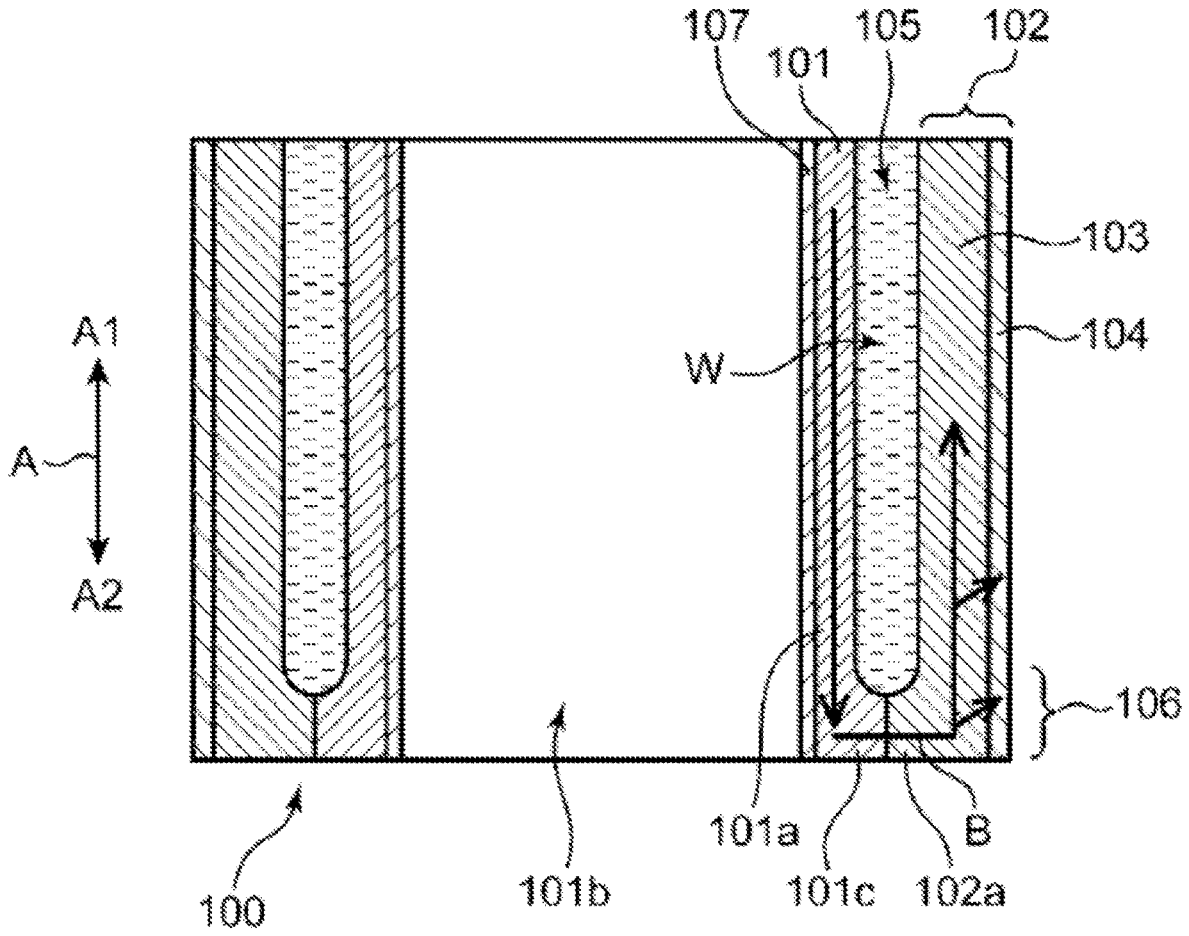
FIG. 5 CONVENTIONAL ART
FIG. 5 is a cross-sectional view of a conventional cylinder block.

Modifications (A) Although in the cylinder block 1 of the above embodiment the inner layer 5 is made only of the fiber reinforced resin, the present disclosure is not limited to this configuration. As a modification of the present disclosure, as illustrated in FIG. 4, the inner layer 5 may contain hollow particles 5*b* in fiber reinforced resin 5*a*. As the hollow particles 5*b*, glass beads are used, for example.

With this configuration, since the inner layer 5 contains the hollow particles 5*b*, it is possible to further improve the heat insulation performance of the inner layer 5 by air inside the hollow particles 5*b*.

(B) Moreover, as a further modification of the present disclosure, the density of the hollow particles 5*b* in the part 9*a* of the inner layer 5 at the bottom dead center side A2 in the cylinder axis direction A (see FIG. 4) is desirably higher than the density of the hollow particles 5*b* in the part at the top dead center side A1.

With this configuration, it is possible to further improve the heat insulation performance in the part 9*a* of the inner layer 5 at the bottom dead center side A2. Therefore, the escape of the heat from the part 9*a* of the cylinder liner 11 at the bottom dead center side A2 to the outer wall part 3 is further suppressed to further reduce the unevenness of the temperature distribution of the cylinder liner 11 in the cylinder axis direction A.

(C) Although in the above embodiment, as illustrated in FIG. 4, the thickness t3 (see FIG. 3) of the outer layer 6 only in the part 13 at the bottom dead center side A2 in the cylinder axis direction A at the position Q2 corresponding to the inter-bore part P2 is greater than the thickness of the outer layer 6 in the part Q1 corresponding to the axis C of the cylinder 2*b* (in detail, the bore center part P1) (the thickness of the stepped part 12 as illustrated in FIG. 2) to increase the heat dissipation, the present disclosure is not limited to this configuration. In the present disclosure, the thickness t3 of the outer layer 6 at least in the part 13 at the bottom dead center side A2 in the cylinder axis direction A at the position Q2 corresponding to the inter-bore part P2 is desirably greater than the thickness of the outer layer 6 in the part Q1 corresponding to the axis C of the cylinder 2*b*. Thus, for example, as a modification of the present disclosure, the thickness of the outer layer 6 at the position Q2 corresponding to the inter-bore part P2 may be relatively greater than the thickness of the outer layer 6 in the part Q1 corresponding to the axis C of the cylinder 2*b*, throughout the height of the outer layer 6 in the cylinder axis direction A. In that case, it is possible to reduce the unevenness of the temperature distribution of the inter-bore part P2 and at the axis C of the cylinder 2*b* (in detail, the bore center part P1) throughout the length of the cylinder 2*b*, and, as a result, it is possible to reduce the uneven deformation of the cylinder liner 11 in the circumferential direction.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Cylinder Block
2 Body Part
3 Outer Wall Part
5 Inner Layer
6 Outer Layer
9*a* Part of Inner Layer at Bottom Dead Center Side
9*b* Part of Inner Layer at Top Dead Center Side
10*a* Part of Outer Layer at Top Dead Center Side
10*b* Part of Outer Layer at Bottom Dead Center Side
11 Cylinder Liner
12 Stepped Part

What is claimed is:

1. A cylinder block, comprising:

a body part made of metal, having a circumferential wall forming a cylindrical cylinder where a piston is reciprocatable therein, and a bottom wall forming part protruding outwardly from an external surface of the circumferential wall; and an outer wall part made of fiber reinforced resin, surrounding an outer circumference of the body part and forming a cooling water passage together with the circumferential wall and the bottom wall forming part, wherein a part of the outer wall part at a bottom dead center side in a cylinder axis direction is in contact with the bottom wall forming part, wherein the outer wall part is comprised of an inner layer surrounding the outer circumference of the body part, and an outer layer surrounding an outer circumference of the inner layer, wherein a density of reinforcing fiber contained in the outer layer is higher than a density of reinforcing fiber contained in the inner layer, wherein a thickness of a part of the inner layer at the bottom dead center side in the cylinder axis direction is greater than a thickness of a part of the inner layer at a top dead center side, and wherein a thickness of a part of the outer layer at the top dead center side in the cylinder axis direction is greater than a thickness of a part of the outer layer at the bottom dead center side.

2. The cylinder block of claim 1, wherein the outer layer is formed by laminating sheets made of fiber reinforced resin in a thickness direction of the outer layer, the outer layer being configured so that the number of sheets at the bottom dead center side in the cylinder axis direction is less than the number of sheets at the top dead center side.

3. The cylinder block of claim 2, wherein a stepped part is formed in the outer layer at the bottom dead center side in the cylinder axis direction by gradually reducing the number of sheets to the bottom dead center side.

4. The cylinder block of claim 3, wherein the inner layer contains hollow particles.

5. The cylinder block of claim 4, wherein a density of the hollow particles in a part of the inner layer at the bottom dead center side in the cylinder axis direction is higher than a density of the hollow particles in a part of the inner layer at the top dead center side.

6. The cylinder block of claim 5, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

7. The cylinder block of claim 1, wherein the inner layer contains hollow particles.

8. The cylinder block of claim 1, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

9. The cylinder block of claim 2, wherein the inner layer contains hollow particles.

10. The cylinder block of claim 2, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

11. The cylinder block of claim 3, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

12. The cylinder block of claim 4, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

13. The cylinder block of claim 7, wherein a density of the hollow particles in a part of the inner layer at the bottom dead center side in the cylinder axis direction is higher than a density of the hollow particles in a part of the inner layer at the top dead center side.

14. The cylinder block of claim 7, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

15. The cylinder block of claim 9, wherein a density of the hollow particles in a part of the inner layer at the bottom dead center side in the cylinder axis direction is higher than a density of the hollow particles in a part of the inner layer at the top dead center side.

16. The cylinder block of claim 9, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

17. The cylinder block of claim 13, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

18. The cylinder block of claim 15, wherein the cylinder includes a plurality of cylinders lined up in an engine output shaft direction, and wherein a thickness of the outer layer at least in a part at the bottom dead center side in the cylinder axis direction at a position corresponding to an inter-bore part defined as a coupling part of the adjacent cylinders in the engine output shaft direction is greater than a thickness of the outer layer in a part corresponding to a cylinder axis.

* * * * *